222-129 SR
7/1/86 OR 4,597,509

United States Patent [19]

Pereira

[11] Patent Number: 4,597,509

[45] Date of Patent: Jul. 1, 1986

[54] DRINKING WATER DISPENSING UNIT AND METHOD

[75] Inventor: LeRoy A. Pereira, LaCanada, Calif.

[73] Assignee: McKesson Corporation, Los Angeles, Calif.

[21] Appl. No.: 671,120

[22] Filed: Nov. 13, 1984

[51] Int. Cl.[4] ..... B67D 5/56; B67D 5/62; F02M 31/00

[52] U.S. Cl. ..... 222/129; 222/129.1; 222/146.6; 261/DIG. 7; 261/140 R; 261/157; 62/394

[58] Field of Search ..... 222/146.1, 325, 146.6, 222/183, 129.1, 129.3, 129.4, 482, 129, 190, 144.5; 62/393, 394, 395; 261/DIG. 7, 140 R, 157

[56] References Cited

U.S. PATENT DOCUMENTS

| | | | |
|---|---|---|---|
| 1,682,385 | 8/1928 | Leibing | 62/393 |
| 1,917,927 | 7/1933 | Denslow | 62/394 X |
| 3,367,133 | 2/1968 | Dreis et al. | 62/395 X |
| 3,688,950 | 9/1972 | Parish | 222/146.1 |
| 3,926,342 | 12/1975 | Selvia et al. | 222/146.6 X |
| 4,008,832 | 2/1977 | Rodth | 222/129.1 |

*Primary Examiner*—Joseph J. Rolla
*Assistant Examiner*—Gregory L. Huson
*Attorney, Agent, or Firm*—Flehr, Hohbach, Test, Albritton & Herbert

[57] ABSTRACT

The dispenser of the present invention is operative to dispense both uncarbonated and carbonated drinking water. It consists of a reservoir for retaining uncarbonated drinking water and a first heat exchange associated with the reservoir and supplied with a fluid refrigerant, for maintaining the water at an optimum drinking temperature. The reservoir has a direct connection to a dispensing faucet for dispensing uncarbonated water. In conjunction with this, the unit makes use of a carbonator for dispersing carbon dioxide in water, and a second heat exchanger located within the reservoir in contact with the uncarbonated water. A pump is arranged to take drinking water from the reservoir and delivers it to the carbonator the carbonated water is supplied to the inlet of the second heat exchanger. A second faucet is connected to the outlet of the second heat exchanger to dispense the carbonated water. The invention also includes the method in which the dispensing unit is operated to supply either chilled uncarbonated or carbonated water.

4 Claims, 2 Drawing Figures

DRINKING WATER DISPENSING UNIT AND METHOD

This invention relates generally to drinking water dispensing units which are arranged to dispense both carbonated and uncarbonated water.

Dispensing units such as are employed for dispensing drinking water or other fluid beverages are sometimes provided with means for dispensing carbonated water or beverages, in addition to water or beverages that are uncarbonated. The units presently in use having such capabilities have been relatively complicated and expensive, bearing little resemblance to the simpler electrical dispensing units which are arranged to dispense only chilled drinking water. Other such units are arranged to dispense only carbonated water or beverages.

It is an object of the present invention to provide a dispenser and method of operation, which is relatively inexpensive and simple to construct and maintain.

Another object is to provide a dispenser which can be made by adding components to a dispenser originally made to dispense only drinking water.

In general the dispenser of the present invention is operative to dispense both uncarbonated and carbonated drinking water. It consists of a reservoir for retaining uncarbonated drinking water and a first heat exchange means associated with the reservoir and supplied with a fluid refrigerant, for maintaining the water at an optimum drinking temperature. The reservoir has a direct connection to a dispensing faucet for dispensing uncarbonated water. In conjunction with the foregoing, the unit makes use of a carbonator for dispersing carbon dioxide in water, and a second heat exchange means located within the reservoir in contact with the uncarbonated water. A pump is arranged to take drinking water from the reservoir and delivers it to the carbonator, whereby the water is carbonated. From the carbonator the carbonated water is supplied to the inlet of the second heat exchange means. A second faucet is connected to the outlet of the second heat exchange means to dispense the carbonated water. The invention also includes the method in which the dispensing unit is operated to supply either chilled uncarbonated or carbonated water.

REFERRING TO THE DRAWING

Figure 1:
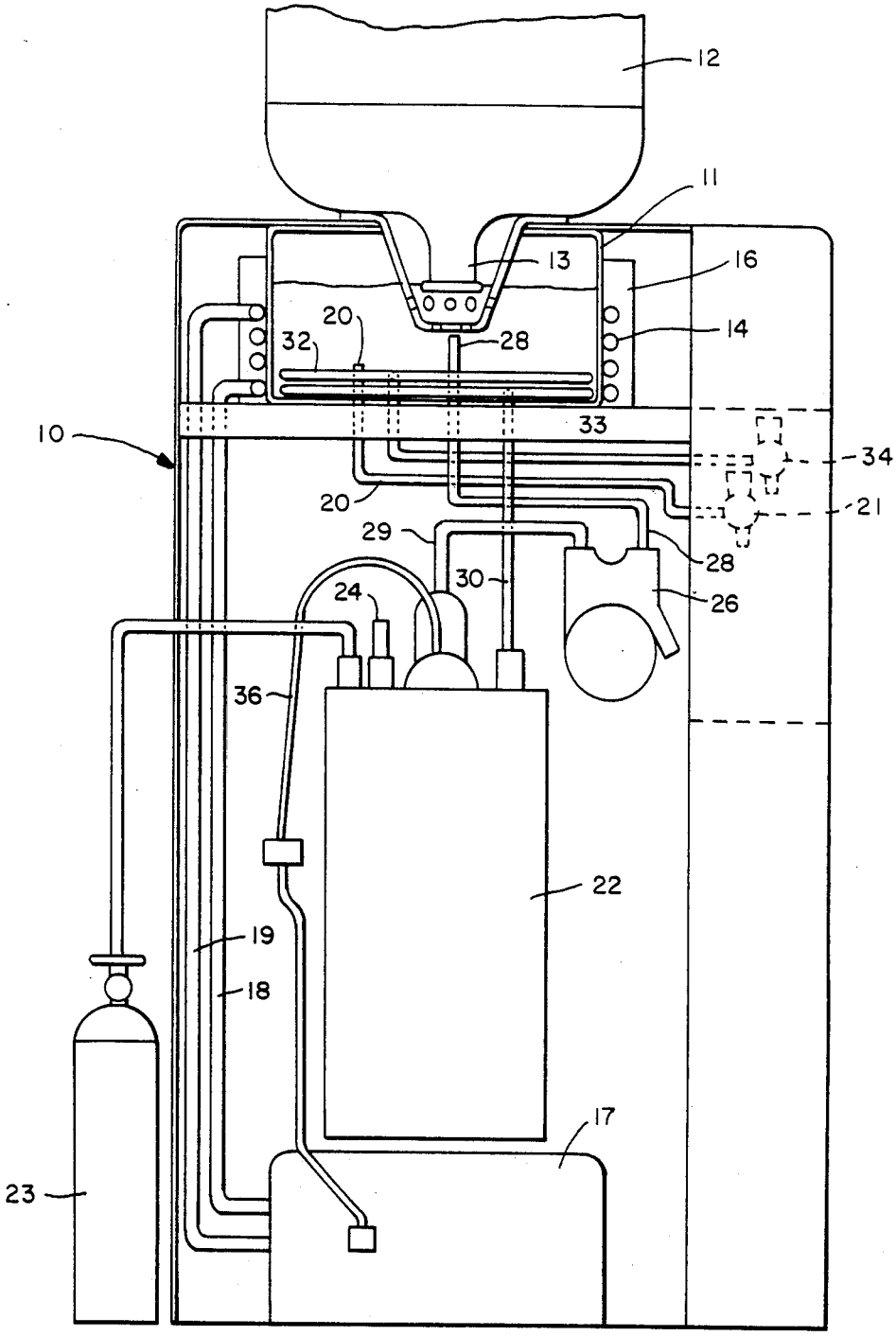
FIG. 1 is a schematic view looking toward one side of the dispenser.
Figure 2:
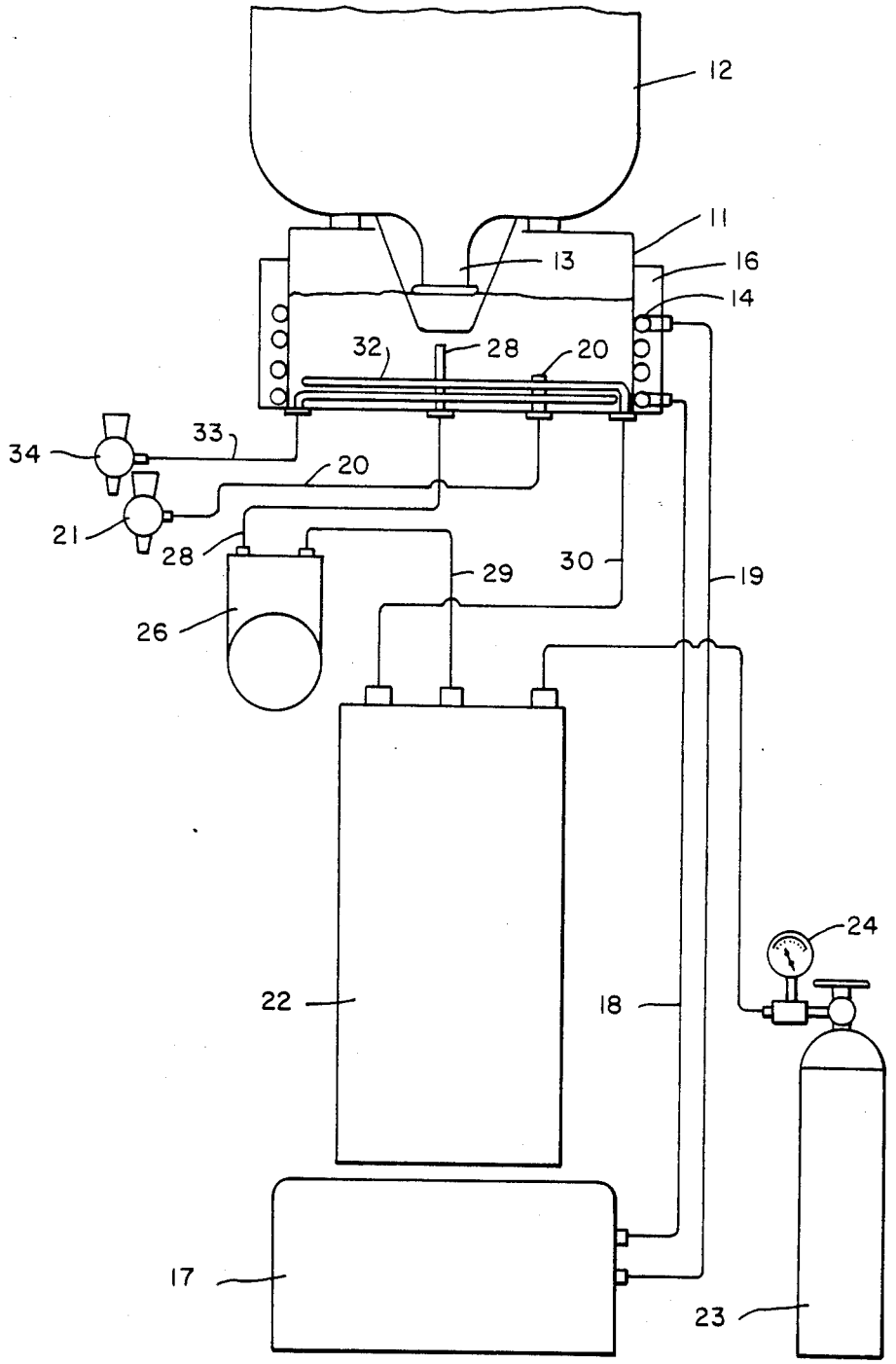
FIG. 2 is a schematic view looking toward the other side of the dispenser.

The dispensing unit as shown schematically in FIGS. 1 and 2 consists of a cabinet 10 having a water reservoir 11 in its upper part. Drinking water is supplied to this reservoir from a suitable source, as for example a bottle 12 which has its neck portion 13 disposed within the upper part of the reservoir 11 in the manner illustrated. This arrangement is similar to that used in drinking water dispensers of the old type. The reservoir 11 is provided with a first heat exchange means, such as cooling coil 14 which surrounds the side walls of the reservoir and is in good heat transfer relationship with the reservoir walls. The exterior surfaces of the cooling coil may be covered with thermal insulating material 16, such as a suitable foamed plastic material. At the bottom of the cabinet there is a commercial refrigerator unit 17, which includes the usual motor driven compressor, and components for carrying out a conventional refrigeration cycle. Assuming that the refrigeration cycle makes use of a material such as Freon, the refrigerant is supplied through pipe 18 to the inlet end of the cooling coil 14, and pipe 19 connects the outlet end of the cooling coil to the refrigerator unit 17. The refrigerator unit is provided with thermostatic control to maintain the water in the reservoir 10 at a desired temperature suitable for drinking water. Pipe 20 extends from the interior of the reservoir 10 to a manual faucet 21 for dispensing uncarbonated water.

A carbonator 22 is disposed in the cabinet of the machine, and is of a commercially available type provided with means for dispersing carbon dioxide gas into drinking water and float control for automatic operation to maintain a body of carbonated water under pressure. A cylinder 23 containing carbon dioxide under pressure, connects with the carbonator. The carbonator generally includes a pressure relief valve 24. An electrically driven pump 26, which may be a part of the carbonator assembly, has its inlet or suction side connected to pipe 28 which has its inlet end within the reservoir 10. The discharge side of pump 26 is connected by pipe 29 with the carbonator 22. A pipe 30 connects the outlet of the carbonator with the inlet end of a second heat exchanger, such as the chill coil 32. This coil is located in the lower part of the reservoir 11, and is in direct contact with the uncarbonated water. The other end of the chill coil 32 is connected by pipe 33 with a manual dispensing faucet 34. An electrical cable 36 supplies power to the carbonator and the motor of pump 26.

While various commercial carbonators can be employed, I prefer to employ a carbonator of the type manufactured by McCann's Engineering and Manufacturing Co., particularly McCann's Solid State Carbonator Model 43-5000.

Operation of the dispenser unit is as follows. Uncarbonated water can be obtained by operation of the dispensing faucet 21. When the dispensing faucet 34 for carbonated water is manually operated, motor 26 is operated intermittently, under the control of the carbonator float whereby water is taken from the reservoir 11 through pipe 28 and introduced by pump 26 into the carbonator. Carbonated water that has been maintained under pressure in the carbonator 22 flows through pipe 30 and coil 32 and is thereby chilled to a temperature near that of the water in reservoir 11. The carbonator 22 in its normal operation maintains a quantity of carbonated water under pressure in preparation for the next dispensing operation. Since during the dispensing of carbonated water, it is caused to flow through the chill coil 32, its temperature is raised to that of the water in the reservoir 11, and, as previously explained, this temperature is maintained by fluid refrigerant being circulated through the coil 14.

As previously explained, the level of water in the reservoir 11 is maintained substantially constant by supply of water from the bottle 12. The pipe 28 has its inlet end extending within the reservoir to a level substantially above the region occupied by the chill coil 32. Therefore, when water is being withdrawn through pipe 28, it cannot lower the level of water in the reservoir 11 below the region occupied by the chill coil 32.

The above description has reference to FIG. 1. FIG. 2 is a schematic diagram that includes the components shown in FIG. 1.

It will be evident from the foregoing that my dispensing unit is relatively simple in its construction and operation. Simplicity makes it possible to readily convert an electrical dispensing unit for dispensing plain drinking water, to one capable of dispensing both plain water and the carbonated water. In its operation, the refrigeration unit in effect serves to cool both the uncarbonated water and the carbonated water, although there is no direct connection between the chill coil 32 and the components for delivering plain water. This is made possible by locating the chill coil 32 within the uncarbonated water reservoir 11, thus utilizing the heat exchanger formed by the coil 14 to maintain both the water within the reservoir and the carbonated water at a temperature level suitable for dispensing.

What is claimed is:

1. A drinking water dispensing unit for dispensing uncarbonated and carbonated drinking water comprising:

(a) a reservoir for retaining uncarbonated drinking water;

(b) refrigerator means for circulating a fluid refrigerant;

(c) first heat exchange means in thermal heat transfer relationship with the reservoir;

(d) piping connecting the first heat exchange means to the refrigerator means whereby refrigerant is caused to circulate through the heat exchange means to cool and maintain the water in the reservoir at a desired temperature;

(e) a carbonator unit for dispersing carbon dioxide in water under pressure, the carbonator unit having an inlet for receiving water to be carbonated and an outlet for the discharge of carbonated water;

(f) a second heat exchange means in heat transfer relationship with water in the reservoir, said second means having an inlet and an outlet;

(g) a pump having an inlet and an outlet; piping connecting the pump inlet with the interior of the reservoir and connecting the pump outlet to the carbonator, whereby operation of the pump takes water from the reservoir and delivers it to the carbonator;

(h) piping connecting the outlet of the carbonator to the inlet of the second heat exchange means;

(i) two manually operated dispensing faucets;

(j) piping connecting one of the faucets to the interior of the reservoir to receive uncarbonated water;

(k) piping connecting the other faucet to the outlet of the second heat exchange means whereby carbonated water is dispensed through the second faucet.

2. A water dispening unit as in claim 1 in which the pipe which connects the interior of the reservoir to the pump has an open inlet end located at a level above the second heat exchange means.

3. A method of dispensing either uncarbonated or carbonated drinking water from separate first and second faucets of a dispensing unit, the unit comprising a reservoir adapted to store uncarbonated drinking water, refrigerator means, heat exchange means connected with the refrigerating means and disposed in heat exchange relationship with the reservoir and serving to cool and maintain water in the reservoir at a desired temperature, and a carbonator for dispersing carbon dioxide gas in water, the method comprising:

(a) pumping uncarbonated water from the reservoir to the carbonator;

(b) delivering carbonated water from the carbonator to heat exchange means located within the reservoir, whereby the carbonated water is chilled;

(c) supplying the chilled carbonated water to one of the dispensing faucets; and (d) supplying uncarbonated water from the reservoir to the other dispensing faucet.

4. A method as in claim 3 in which the heat exchange means connected to the carbonator is located in the lower portion of the reservoir, and water is withdrawn from the reservoir at a level above said heat exchange means, and supplied to the carbonator.

* * * * *